US006471403B1

(12) United States Patent
Janssen

(10) Patent No.: US 6,471,403 B1
(45) **Date of Patent: *Oct. 29, 2002**

(54) VALVE BAG

(75) Inventor: Paulus Johannes Maria Janssen, Heerlen (NL)

(73) Assignee: Frantschach Industrial Packaging Netherlands NV, PA Maastricht (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/269,626

(22) PCT Filed: Nov. 4, 1997

(86) PCT No.: PCT/NL97/00602

§ 371 (c)(1),
(2), (4) Date: Mar. 30, 1999

(87) PCT Pub. No.: WO98/19927

PCT Pub. Date: May 14, 1998

(30) Foreign Application Priority Data

Nov. 4, 1996 (NL) ..... 1004420

(51) Int. Cl.[7] ..... B65D 30/24
(52) U.S. Cl. ..... 383/54; 383/44; 383/48
(58) Field of Search ..... 383/44, 46, 48, 383/49, 50, 52, 53, 54, 210

(56) References Cited

U.S. PATENT DOCUMENTS

| | | | | | |
|---|---|---|---|---|---|
| 1,782,738 | A | * | 11/1930 | Martin | 383/50 |
| 1,827,040 | A | * | 10/1931 | Redington | 383/48 X |
| 2,045,585 | A | * | 6/1936 | Coty | 383/48 |
| 2,620,121 | A | * | 12/1952 | Johnsson | 383/50 X |
| 3,162,354 | A | * | 12/1964 | Frankel | 383/50 |
| 3,235,169 | A | * | 2/1966 | Gennerich et al. | 383/48 |
| 3,653,913 | A | * | 4/1972 | Rambold | 383/107 |
| 4,066,108 | A | * | 1/1978 | Lau | 383/48 X |
| 4,367,620 | A | * | 1/1983 | Fox | 383/48 X |
| 5,044,499 | A | * | 9/1991 | Marion | 206/438 |
| 5,177,932 | A | * | 1/1993 | Schnetzer | 53/228 |
| 5,340,638 | A | * | 8/1994 | Sperner | 428/182 |
| 5,516,210 | A | * | 5/1996 | Kelley et al. | 383/46 X |

FOREIGN PATENT DOCUMENTS

| | | | | |
|---|---|---|---|---|
| DE | 829548 | | 1/1952 | |
| DE | 1 008 100 | * | 5/1957 | 383/48 |
| DE | 2218867 | * | 10/1973 | 383/44 |
| DE | 3108663 | | 10/1982 | |
| DE | 3414199 | | 10/1985 | |
| EP | 0160357 | | 11/1985 | |
| GB | 777107 | * | 6/1957 | 383/48 |
| GB | 1449879 | | 9/1976 | |
| HU | 188915 | | 8/1985 | |

* cited by examiner

*Primary Examiner*—Jes F. Pascua
(74) *Attorney, Agent, or Firm*—Ladas & Parry

(57) ABSTRACT

A method for closing a valved sack having one or more layers of flexible material. The valved sack has a filling opening which is closed after filling the valved sack. The filling opening is formed by opposite layers of material, which when closing the valved sack, are on top of one another and are undetachably joined. The method involves closing the filling opening by joining the layers of material which are on top of one another by plastic deformation without applying heat. A valved sack formed by the method is also described.

20 Claims, 2 Drawing Sheets

VALVE BAG

FIELD OF INVENTION

The invention relates to a method for closing a valved sack and to a closed valved sack.

BACKGROUND OF INVENTION

Valved sacks are generally known and are formed of one or more layers of flexible material such as paper or plastic. The valved sack is provided with a filling opening, which is formed by opposite layers of material which are not joined when manufacturing the sack. Valved sacks are filled with bulk cargo, for instance building material like cement, or foodstuffs like flour, which is brought into the valved sack through the filling opening. The filling opening is shaped such that the opposite layers of material are pressed onto one another after filling the valved sack, in order to prevent the contents of the valved sack from streaming out. The filing opening thus acts as a one-way valve. In practice, however, it turned out that for many kinds of bulk cargo streaming out is not prevented to a sufficient extent. In those cases the valved sacks are closed by bringing the opposite layers of material against each other and joining them undetachably. With plastic valved sacks the connection is usually effected by thermo-welding or by applying glue, for instance a hotmeltglue. With paper valved sacks the opposite layers of material are usually glued to each other, or welded together by heat when they are provided with a (plastic) coating. Thus the filling opening cannot be opened and closed again after closing.

A disadvantage of these known methods is that in the case of welding heat is supplied, which may be detrimental to the quality of the contents of the valved sack, for instance foodstuffs. In the case of gluing it is the glue itself which may be detrimental to the quality of the contents. In both cases it is so that while filling remnants of the contents may be left behind in the filling opening, because of which the attachment of the heat weld or the glue can be insufficient for a good closing of the valved sack. The supply of glue or a (plastic) coating to a paper valved sack also has the disadvantage that the valved sack cannot be entirely recycled just like that.

SUMMARY OF INVENTION

It is an object of the invention to provide an improved closing of valved sacks.

To that end according to a first aspect of the invention a method is provided for closing a valved sack of one or more layers of flexible material such as paper or plastic, in which the valved sack has a filling opening which is closed after filling the valved sack, in which the filling opening is formed by opposite layers of material, which when closing the valved sack are on top of one another and are undetachably joined, characterized in that the filling opening is closed by joining the layers of material which are on top of one another by plastic deformation.

By mechanically joining the layers of material which are on top of one another, neither heat nor material alien to paper such as glue or a (plastic) coating has to be supplied. The mechanical connection can be quickly effected. By the plastic deformation remnants of the contents are either pushed away or included in the deformed layers of material, without notably influencing the closing function of the connection. Because hardly any forces which would open the filling opening act on a closed filling opening, plastic deformation of the layers of material offers a sufficiently firm connection for the desired closing of the valved sack.

Preferably the filling opening is closed by joining the material layers which are on top of one another with a connection in the form of a band along substantially the entire width of the filling opening. In this way the valved sack is closed entirely.

The connection in the form of a band is advantageously obtained by corrugating the layers of material on the spot, in which the corrugations provide a firm plastic deformation, which can be applied easily.

Preferably the plastic deformation is obtained by pressure welding or knurling the layers of material which are on top of one another. When pressure welding or knurling (compare to the German "prägen") a relief is pressed into the material, resulting in a mechanical connection between the layers of material which are on top of one another.

Preferably the valved sack is provided with a tube of flexible material such as paper or plastic arranged in the filling opening, which tube partially protrudes after filling the valved sack, in which after filling the valved sack the sides of the protruding portion of the tube that are on top of one another are joined by plastic deformation. After filling the protruding portion of the tube can be easily engaged by a machine.

More preferably the valved sack is a valved hexagonal bottom sack, of which the protruding portion of the tube is closed by plastic deformation, after filling the valved sack.

According to a second aspect of the invention a valved sack is provided of one or more layers of flexible material such as paper or plastic, provided with a filling opening formed by opposite layers of material, which valved sack is closed after filling, in which the opposite layers of material are on top of one another and are undetachably joined, characterized in that the layers of material which are on top of one another are joined by plastic deformation.

In this way a valved sack is provided, which without the supply of heat or adding material alien to paper provides a good closing against the streaming out of the contents of the valved sack. With paper sacks the valved sack remains entirely recyclable.

Preferably the plastic deformation extends in the form of a band along substantially the entire width of the filling opening, in which preferably a corrugated profile is applied and preferably the plastic deformation is effected by pressure welding or knurling.

According to a advantageous embodiment the valved sack is provided with a tube of flexible material such as paper or plastic, arranged in the filling opening, which tube partially protrudes after filling the valved sack, in which the tube is closed by plastic deformation of its sides which are on top of one another, and preferably the valved sack is a valved hexagonal bottom sack.

BRIEF DESCRIPTION OF DRAWINGS

The invention will be elucidated below on the basis of drawings.

DETAILED DESCRIPTION

Figure 1:
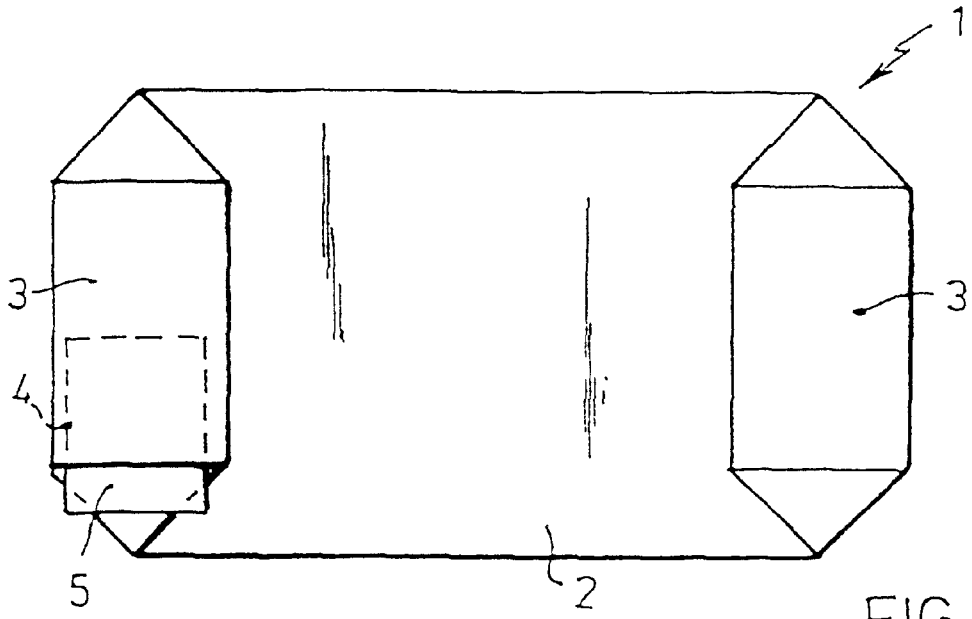
FIG. 1 shows an unfilled valved hexagonal bottom sack with a partially protruding tube.

FIG. 1 shows a valved hexagonal bottom sack 1 consisting of a sack body 2 and two hexagonal bottoms 3, in which in one of the hexagonal bottoms 3 a filling opening is left open, in which a tube 4 is arranged. The tube 4 is mainly incorporated in the hexagonal bottom (the portion indicated by dots) and has a protruding portion 5 which protrudes outside of the hexagonal bottom. The valved hexagonal bottom sack 1 is shown flat folded in FIG. 1.

During the filling of the valved hexagonal bottom sack the tube 4 serves as supply valve for bulk cargo with which the valved sack is filled.

Figure 2:
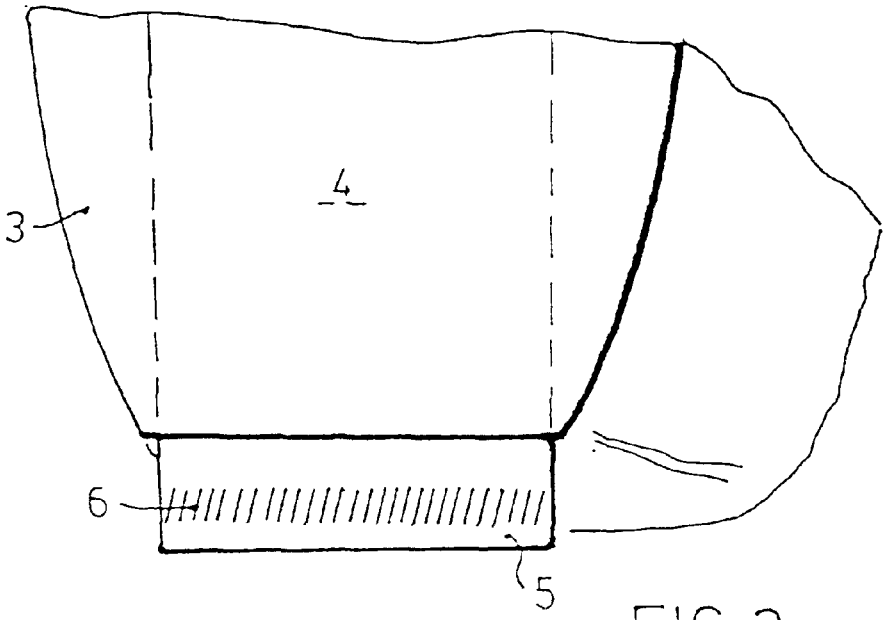
FIG. 2 shows on a larger scale a portion of the valved hexagonal bottom sack according to FIG. 1 in filled condition with closed tube, seen on the hexagonal bottom with the tube.

After filling the valved hexagonal bottom sack the protruding portion 5 of the tube 4 protrudes outside the filled body of the valved sack. This is shown in FIG. 2. The protruding portion 5 of the tube is provided with a plastically deformed band 6, where the sides of the tube which are on top of one another are joined by plastic deformation of the material of the tube. The mechanical deformation is applied in the form of a corrugated profile, which extends along the entire width of the tube 4. It will be clear that instead of a corrugated profile a band with a pointed profile can be opted for as well, and that instead of mechanical deformation in the form of a band a mechanical deformation in discrete places of the protruding portion 5 of the valve 4 can also be opted for in order to obtain a good closing of the protruding portion 5.

When filling the sacks the valved sack with the tube 4 is engaged at the top, the (flat folded) valve 4 is opened and a filling pipe is stuck into the tube, through which the bulk cargo is brought into the valved sack. After filling and removing the filling pipe the filled valved sack drops on a conveyor belt or the valved sack is positioned such that the protruding portion 5 of the tube 4 can easily be engaged by a closing machine, which presses both sides of the protruding portion 5 onto one another and joins them by plastic deformation. Subsequently the sacks can be transported to a palletization device, which stacks the filled valved sacks onto a pallet.

Joining by plastic deformation is in itself known in another area of the art, for instance in the manufacturing of paper coffee filterbags, but has never been applied in the area of art regarding valved sacks.

Joining both sides of the protruding portion 5 of the tube 4 by plastic deformation provides a good closing of the valved sack, which can be effected in a simple way, without having to supply heat or glue.

Figure 3:
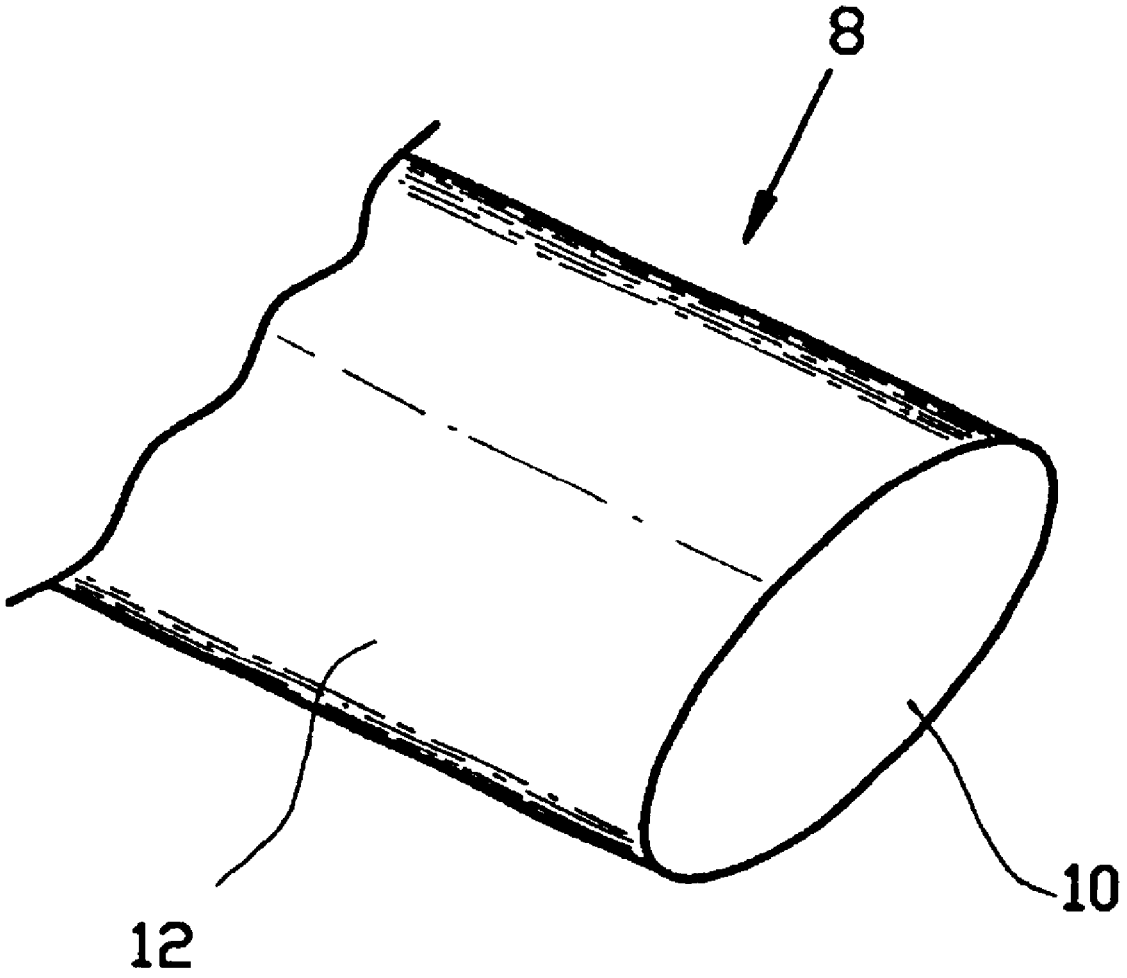
FIG. 3 shows a portion of a filling opening of a valved sack formed by opposite layers of material without a feeding tube.

The invention has been described on the basis of a valved hexagonal bottom sack, which preferably is made out of paper. It will be clear that the invention is also applicable to a valved sack in which the filling opening is arranged in a longitudinal seam of the valved sack, and also to valved sacks without a tube, when the valved sack has a filling opening which is formed by opposite layers of material, which together can be engaged to effect a plastic deformation. This is shown in FIG. 3 wherein a filling opening of valved sack 8 is formed by opposite layers 10 and 12. The invention is also applicable to plastic valved sacks.

What is claimed is:

1. In a valved sack of one or more layers of flexible material provided with a filling opening formed by opposite layers of material, wherein the opposite layers of material are on top of one another and are undetachably joined to form a joinder, the improvement wherein the joinder consists of a mechanical connection formed by pressing the opposite layers of material together to effect a plastic deformation of the opposite layers that closes the filling opening with the opposite layers on top of, and in contact with, one another along substantially an entire width of the filling opening, said opposite layers maintaining a planar disposition with respect to one another both prior to and after the plastic deformation.

2. The valved sack according to claim 1, wherein the mechanical connection is formed by knurling or pressure welding the opposite layers of material together.

3. The valved sack according to claim 1, wherein the mechanical connection is formed with a pointed profile.

4. The valved sack according to claim 1, wherein the mechanical connection is formed by corrugating the opposite layers of material together.

5. The valved sack according to claim 1, wherein the valved sack is a valved hexagonal bottom sack.

6. The valved sack according to claim 1, wherein the flexible material is paper or plastic.

7. In a method for closing a valved sack comprising one or more layers of flexible material, wherein the valved sack has a filling opening which is closed after filling the valved sack, the filling opening being formed by opposite layers of material which, when closing the valved sack, are on top of one another and are undetachably joined to form a joinder, the improvement wherein the joinder consists of a mechanical connection formed by pressing the opposite layers of material together to effect a plastic deformation of the opposite layers that closes the filling opening with the opposite layers on top of, and in contact with, one another along substantially an entire width of the filling opening and in an area where both of the opposite layers are plastically deformed, said opposite layers maintaining a planar disposition with respect to one another both prior to and after the plastic deformation.

8. The method according to claim 7, wherein the mechanical connection is formed by corrugating the opposite layers of material together.

9. The method according to claim 7, wherein the mechanical connection is formed by pressure welding the opposite layers of material together.

10. The method according to claim 7, wherein the mechanical connection is formed with a pointed profile.

11. The method according to claim 7, wherein the mechanical connection is formed without application of heat.

12. The method according to claim 7, wherein the plastic deformation is effected by knurling the opposite layers of material together.

13. A method for forming a valved sack, the method comprising a) forming one or more layers of flexible material into a sack;

b) providing the sack with a tube of flexible material having opposed sides that define an opening for filling the sack, said tube being disposed in the sack so that a part of the tube protrudes from the sack when the sack is full; and c) joining the opposed sides of the protruding part of the tube to form a mechanical connection by pressing the opposed sides together to effect a plastic deformation of the opposed sides that closes the opening with the opposed sides on top of, and in contact with, one another along substantially an entire width of the opening, said opposed sides maintaining a planar disposition with respect to one another both prior to and after the plastic deformation.

14. The method according to claim 13, wherein the mechanical connection is formed by pressure welding the opposed sides together.

15. The method according to claim 13, wherein the mechanical connection is formed by knurling the opposed sides together.

16. The method according to claim 13, wherein the mechanical connection is formed by corrugating the opposed sides together.

17. The method according to claim 13, wherein the mechanical connection is formed without application of heat.

18. The valved sack formed by the method of claim 13.

19. In a method for closing a valved sack comprising one or more layers of flexible material, wherein the valved sack has a filling opening which is closed after filling the valved sack, the filling opening being formed by opposite layers of material which, when closing the valved sack, are on top of one another and are undetachably joined, the improvement wherein the opposite layers are on top of, and in contact with, one another along substantially an entire width of the filling opening, said method comprising closing the filling opening by joining the layers of material which are on top of one another by corrugating the opposite layers of material, said opposite layers maintaining a planar disposition with respect to one another both prior to and after the corrugating.

20. The method according to claim 19, wherein the flexible material comprises paper or plastic.

* * * * *